United States Patent [19]

Schulz et al.

[11] Patent Number: 4,470,253

[45] Date of Patent: Sep. 11, 1984

[54] SPINNING FRAME, PREFERABLY RING SPINNING FRAME

[75] Inventors: Gunter Schulz, Ebersbach; Friedrich Dinkelmann, Rechberghausen; Konrad Klein, Ebersbach-Sulpach; Roland Emberger, Süben, all of Fed. Rep. of Germany

[73] Assignee: Firma Zinser Textilmaschinen GmbH, Ebersbach, Fed. Rep. of Germany

[21] Appl. No.: 342,021

[22] PCT Filed: Jun. 7, 1981

[86] PCT No.: PCT/EP81/00064

§ 371 Date: Jan. 12, 1982

§ 102(e) Date: Jan. 12, 1982

[87] PCT Pub. No.: WO81/03501

PCT Pub. Date: Dec. 10, 1981

[30] Foreign Application Priority Data

Jun. 9, 1980 [DE] Fed. Rep. of Germany ..... 3021632

[51] Int. Cl.[3] ..... D01H 5/26

[52] U.S. Cl. ..... 57/315; 19/243; 19/244; 19/246; 19/288

[58] Field of Search ..... 57/315, 328–331; 19/243, 244, 246–248, 258, 257, 286, 288

[56] References Cited

U.S. PATENT DOCUMENTS

| | | | |
|---|---|---|---|
| 2,230,399 | 2/1941 | Brandt et al. | 19/244 X |
| 2,430,611 | 11/1947 | Gwaltney et al. | 19/246 |
| 2,470,055 | 5/1949 | Schlums | 19/246 |
| 2,856,643 | 10/1958 | Spencer | 19/244 |
| 3,006,037 | 10/1961 | Bettolo | 19/258 |
| 3,020,697 | 2/1962 | Henry | 19/288 X |
| 3,105,998 | 10/1963 | Raboisson | 19/244 |

FOREIGN PATENT DOCUMENTS

| | | |
|---|---|---|
| 569516 | 8/1958 | Belgium . |
| 908949 | 4/1954 | Fed. Rep. of Germany . |
| 1923377 | 11/1970 | Fed. Rep. of Germany . |
| 2198009 | 3/1974 | France . |
| 513256 | 11/1971 | Switzerland . |
| 993844 | 6/1965 | United Kingdom . |

*Primary Examiner*—John Petrakes

*Attorney, Agent, or Firm*—Sughrue, Mion, Zinn, Macpeak and Seas

[57] ABSTRACT

A spinning frame of the type having a main drafting zone through which two fiber bands move in spaced parallel relation for subsequent twisting into a single yarn is provided with a first pair of rollers located at the entrance to the main drafting zone, a second pair of rollers located at the exit of the main drafting zone, a pair of endless leather tapes extending about a roller in each of the first and second pair of rollers, and a third pair of rollers for delivering two fiber bands from the main drafting zone to a suitable twisting device. A first pair of fiber band guides is located adjacent to and upstream of the first pair of rollers relative to the direction of travel of the fiber band, a second pair of fiber band guides is located intermediate the second and third pairs of rollers and a pair of coaxially spaced apart annular ring slots are provided in the outer surface of one of the first pair of rollers with the first and second pairs of guides being aligned with the ring slots for maintaining the fiber bands in alignment with the ring slots.

7 Claims, 3 Drawing Figures

SPINNING FRAME, PREFERABLY RING SPINNING FRAME

The present invention is directed to spinning frames of the type having main drafting means through which two fiber bands move in spaced parallel relation for subsequent twisting by suitable twisting means wherein one of the entrance rollers of the main drafting means over which an endless leather tape passes is provided with a pair of axially spaced apart parallel annular ring slots.

The uniformity of the yarn produced by such spinning frames often leaves a lot to be desired. It is therefore a task of the invention to improve the uniformity of yarn produced on such spinning frames.

As a consequence of the two ring slots of the upper roller located on the entry side of the main drafting zone and encompassed by an upper apron, the length of the main drafting zone of the drawing system can be adjusted to somewhat less than the length of the longest fiber of the fiber bands without any danger of ripping the fiber; thereby the drafting work of the drawing system and thus the uniformity of the yarn produced from both fiber bands by means of their being twisted together can be improved. The fiber band guides of the drawing system ensure a precise feed of the fiber bands through the drawing system into the position necessary for the two ring slots of the upper roller.

Despite the two ring slots of the upper roller of the entry roller pair of the main drafting zone, the two fiber bands are sufficiently clamped on their way through this pair of entry rollers to enable the main drafting—and in the case where there is a pre-drafting zone, also the pre-drafting—to be precisely carried out. Practically speaking, only the relatively low proportion of fibers which are longer than the main drafting zone distance are pulled through the clamping surface of the entry roller pair more rapidly than the transport speed of the entry roller pair of the main drafting zone, without tearing these long fibers thanks to the ring slots of the upper entry roller. The width of both ring slots of the upper roller of the entry roller pair of the main drafting zone can easily be designed such that fiber bands of varying fiber composition and differing numbers can be drawn. In general it is efficient to arrange things such that the width of each of the two ring slots of this upper roller roughly corresponds to the width of the fiber band under it in the clamping gap of this entry roller pair of the main drafting zone. If fiber bands of widely differing numbers are to be spun on the spinning frame, one can adjust the width of the ring slots of this upper roller according to the width of the fiber bands to be processed on the machine and the maximum weight/length unit. In such a case it is also possible to have two or more sets of upper entry rollers of main drafting zone with ring slots of various widths, which correspond to the various number areas of the fiber bands to be processed, and which can also be interchanged if necessary.

The upper apron ca correspond to the usual drawing systems, particularly those of traditional worsted yarn spinning frames, and the upper roller it encompasses can have a normal elastic covering in which, however, ring slots are located. It is preferable that the main drafting zone also have a lower leather tape. For spinning frames with pre-drafting zones, two fiber band guides can also be advantageous in the pre-drafting zone, whereby the vertical median lengthwise planes of its fiber band guide channels roughly match the vertical median lengthwise planes of the two ring slots of the upper entry roller of the main drafting zone. The upper entry roller of the main drafting zone can also form the upper exit roller of the pre-drafting zone.

The two fiber band guides of each pair of fiber tape guides can advantageously be connected to each other, for example to form a single-piece double fiber band guide.

The two fiber band guides located in the main drafting zone can best be held merely by placing them on the two fiber bands so that they are carried by same. On the other hand, it is useful to arrange all the fiber band guides for the main drafting zone such that they are held immovable during operation.

All fiber band guides can be formed such that their fiber band channels form open rills for the simple feeding of the fiber bands, and they can also be formed such that they become narrow like a funnel for purposes of concentrating the fiber bands in the directin of fiber band movement. Yet it is also possible to have at least one pair of fiber band guides with hole-shaped fiber band channels, if one wishes to accept the time-consuming threading of the fiber bands into these holes.

The fiber bands can preferably be combed wool, but fiber tapes of other finite-length fibers can also be be spun, preferably of fibers with a relatively long average fiber length.

The uniformity of the yarn produced from both fiber tapes when twisted together can be further improved if one guides it through a rotating thread guide located at a distance from the exit of the drawing system and into a fiber balloon formed by same; the reason is that the rotation imparted to the yarn propagates itself more efficiently in the area between the drawing system and this thread guide. Preferably, this thread guide can rotate with about the same rpm as the spindle, etc., to which the yarn flows. For example, the rotating thread guide can be shaped as in DE-OS No. 23 43 776.

When the spinning frame is designed as a ring spinning frame, a thread guide is located at a relatively small distance above the spindle of each spinning location; such thread guides are preferably the rotating thread guides mentioned above, or could also be non-rotating. It is preferable that the smallest internal diameter of this thread guide is 2 mm if possible, or less, since by this means the otherwise easily occurring formation of a weak fiber balloon between the union point of the two individual fibers and this thread guide, which worsens the uniformity of the yarn, can be avoided.

A design example is illustrated in the drawing.

Figure 1:
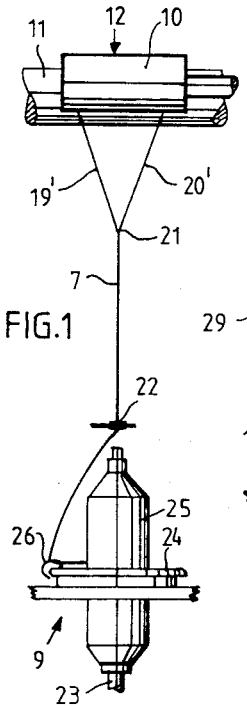
FIG. 1 shows a cross-sectional front view of a spinning location of a ring spinning frame which is not drawn in further detail.

The spinning location 9 depicted in cross-section in FIG. 1, one of many such spinning locations of a ring spinning frame, has a delivery roller pair 12, consisting of an upper roller 10 and a lower roller 11, of a drawing system 13 which is not illustrated in further detail in FIG. 1. The drawing system illustrated in greater detail in FIG. 2 has two such spinning locations 9 next to one another. For a better view into the drawing system 13, the upper apron 14 in FIG. 2 at the left spinning location 9 is illustrated in cutaway view, and the upper delivery roller 10 is broken away. For each spinning location 9 the drawing system 13 has a pre-drafting zone 15 and a main drafting zone 16. In the pre-drafting field 15 only low drafting or only coordination drafting is carried out on the two fiber bands 19, 20 which are to be drawn, and in the main drafting field 16 these two fiber bands 19, 20 are then drafted with a high drafting force and then go from the delivery roller pair 12 (still untwisted) and to a union point 21, where they are then twisted together to form a finished yarn 7, which is then (as in FIG. 1) routed through a thread guide 22 coaxial with a rotating spindle 23, through a traveller 26 moving around a spinning ring 24 to the spindle 23, where it is wound onto a bobbin on the spindle 23 into a winding 25. The two fiber bands located between the delivery roller pair 12 and the union point 21 are designated as individual fibers 19' and 20'.

The drawing system portion which relates to an individual spinning location 9 is described below.

Through each portion of the drawing system, two fiber bands 19, 20 running in spaced parallel relation to each other, are drafted at the same time. These two fiber bands 19, 20 can preferably come from a single feeding spool, upon which they were simultaneously wound.

The pre-drafting field 15 is bordered on the one side by a feed roller pair consisting of a lower roller 29 and an upper roller 30 which presses against it, and on the exit side by a center roller pair consisting of a center lower roller 31 and an upper roller 32 surrounded by the endless upper apron 14. The upper apron 14 is carried by a guiding cage 33 which also guides the other upper apron 14 of this drawing system 13, and is then routed around by the forward edge 60 of the cage half 61 assigned to it, with little clearance, and then lies on the outer surface of the center upper roller 32 at an angle of somewhat more than 180°. This center upper roller pair 31,32 also forms the entry roller pair of the main drafting zone 16, whose exit roller pair forms the delivery roller pair 12.

Figure 2:
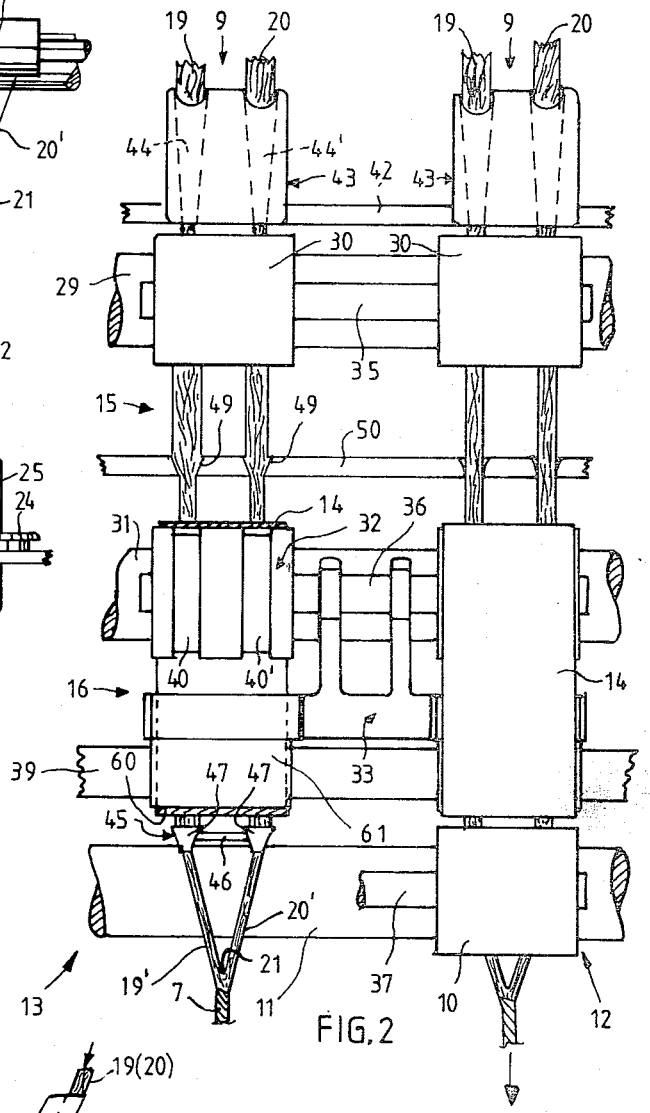
FIG. 2 shows a partially-cross-sectional top view for a drawing system with two spinning locations of a ring spinning frame located next to each other, as in FIG. 1, whereby certain portions are cut away for a better view.

The upper rollers 30, 32, and 10 of the drawing system which are pressed against the corresponding lower rollers 29, 31, and 11 as in FIG. 2 are at any given time rotatable about common shafts 35, 36, and 37 respectively, which in turn is carried by a normal upper roller carrier (not illustrated) and spring loaded.

In addition, lower aprons of the usual kind are located around the center lower roller 31 and a routing rail 39, and if need be they are tensioned by a tension roller, not illustrated; while these tapes are not visible, they are located in FIG. 2 directly below the upper apron 14, such that the two fiber bands 19,20 in the main drawing zone 16 are guided between the upper apron and lower apron.

The three lower rollers 29, 31, and 11 of this drawing system 13 can, as is normal, be formed via long roller elements which run along the appropriate side of the ring spinning frame (not further illustrated), and which can be the same as all the drawing systems of this side of the machine.

The upper roller 32 surrounded by the upper apron 14 has the usual elastic cot of plastic or the equivalent, but in which there are two flat ring slots 40, 40'—a departure from the normal technique in this invention—which are right-angular, constant, and have a consistently large cross section, and which are coaxial with the rotating axis of the upper roller 32 and covered by the upper apron 14.

Figure 3:
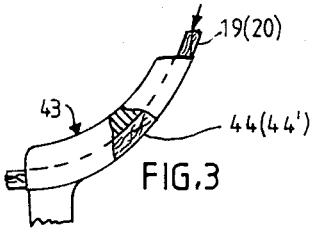
FIG. 3 shows a side view of a double fiber tape guide of the drafting system according to FIG. 2.

On a fixed carrier brace 42 which runs along the appropriate side of the frame, a double fiber band guide 43 is located a short distance from each gathering roller pair 29, 30 and has two convex arc-shaped (in relation to lengthwise direction in FIG. 3) channel-type guide grooves 44, 44' serving to guide the two fiber bands 19, 20. This double fiber band guide 43 consists of a single-piece injection molded component and is affixed to the stationary carrier brace 42. Its two grooves 44,44' become narrower in a funnel-like fashion in the direction of fiber movement, in order to concentrate the two fiber bands 19, 20. These grooves 44, 44' are open to the bottom.

In each main drawing zone 16 there is also a double fiber band guide 45, which consists of two fiber band guides 47 held together by a stiff brace 46 and which are open at the bottom. They narrow in the direction of fiber band movement, and each have a groove open toward the bottom to guide the two fiber bands 19,20. This double fiber band guide 45 is placed upon the two fiber bands 19, 20 from above and is carried by these, and thus pressed against at least one of the two rollers 10, 11 of the delivery roller pair 12.

In each pre-drafting zone 15 are likewise two fiber band guides 49 for the two fiber bands 19, 20 which run through it. They are mounted on one of the fixed rails 50 which run along the spinning frame and each of which has a funnel-shaped groove (in relation to the direction of fiber movement) open at the top, to guide the fiber bands 19, 20. The median distance of the grooves of these two fiber band guides 49 (which form the fiber band guide channels) from each other, as well as the median distance of the two grooves 44, 44' which also form fiber band guide channels for the double fiber band guide 43, and also the median distance of the two grooves of the fiber band guide 47 which likewise form fiber band guide channels for the fiber band guide 47 of the double fiber band guide 45, are all equally large, and correspond to the median clearance of the two ring slots 40, 40' of the appropriate drafting system upper roller 32. The vertical lengthwise median planes of the grooves of the fiber band guides 43, 49, and 45 guiding the same fiber band 19 and 20 respectively, roughly overlap one another as well as the vertical lengthwise median plane of the ring slot 40, 40' of the upper roller 32 above the appropriate fiber band 19 or 20. The width of the ring slot 40, 40' is approximately the same size as or somewhat larger than the width of the fiber band which is located under it and moves through the clamping gap to the center roller pair 31, 32. The extent of the main drafting zone 16 is adjusted to be a bit smaller than the maximum fiber length of the fibers in the fiber bands to be drawn 19, 20. This is done to improve the uniformity of the spun yarn 7 through improved drafting. The long fibers, if they are in contact with the delivery roller pair 12, can be pulled out from the clamping gap of the center roller pair 31, 32 without tearing thanks to the grooves 40, 40' on the upper roller 32.

We claim:

1. In a spinning frame of the type having main drafting means through which two fiber bands move in spaced apart relation for subsequent twisting by suitable twisting means comprising a first pair of rollers located at the entrance to said main drafting means, a second pair of rollers located at the exit of said main drafting means for delivering the two fiber bands from said main drafting means to said twisting means, and an endless apron extending about the upper roller of said first pair of rollers, the improvement comprising a first pair of fiber band guides located upstream of said first pair of rollers relative to the direction of movement of said bands, a second pair of fiber band guides located intermediate said first and second pairs of rollers and a pair of coaxial spaced apart annular ring slots provided in the outer surface of the upper roller of said first pair of rollers with said first and second pairs of guides being substantially aligned with said ring slots for maintaining said fiber bands in alignment with said ring slots.

2. A spinning frame as set forth in claim 1 further comprising pre-drafting means located upstream of said main drafting means comprising a third pair of rollers upstream of said first pair of rollers, and a third pair of fiber band guides located upstream of said pre-drafting means substantially in alignment with said first and second pairs of fiber band guides and said pair of ring slots, respectively, said first pair of fiber band guides being located intermediate said first and third pairs of rollers.

3. A spinning frame as set forth in claim 1 wherein said second pair of fiber band guides is comprised of two interconnected fiber band guides each of which is provided with a downwardly open groove for receiving a respective fiber band whereby each fiber band guide is supported directly on the respective fiber band.

4. A spinning frame as set forth in claim 1 wherein each fiber band guide includes a groove which becomes narrower in the direction of fiber band movement for the purpose of concentrating the fiber band passing therethrough.

5. A spinning frame as set forth in claim 1 wherein each of said fiber band guides is provided with an open groove for guiding a fiber band to facilitate the initial feeding of the fiber bands through the guides.

6. A spinning frame as set forth in claim 1 wherein the width of each of said ring slots is at least equal to the width of the fiber band passing over the associated apron.

7. A spinning frame as set forth in claim 1 wherein said twisting means is comprised of a spindle having ring and traveller means associated therewith and further comprising a yarn guide having an aperture disposed in coaxial relation to said spindle with the diameter of said yarn guide means sufficiently small relative to the twisted yarn so as to prevent ballooning of the yarn upstream of said yarn guide.

* * * * *